US006371097B1

(12) United States Patent
Rossi

(10) Patent No.: US 6,371,097 B1
(45) Date of Patent: Apr. 16, 2002

(54) UEGO CONTROL CIRCUIT BOARD PORTION WITH ASIC

(75) Inventor: Robert Edward Rossi, Northville, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 09/608,280

(22) Filed: Jun. 30, 2000

(51) Int. Cl.[7] ..... F02D 41/00
(52) U.S. Cl. ..... 123/691; 123/696; 123/697
(58) Field of Search ..... 123/696, 697, 123/691, 692, 672; 73/23.32; 701/109; 60/276, 285

(56) References Cited

U.S. PATENT DOCUMENTS 4,231,733 A * 11/1980 Hickman et al. ..... 431/76
5,106,481 A * 4/1992 Rankin et al. ..... 204/426
5,211,154 A * 5/1993 Brandt ..... 123/693
5,333,591 A * 8/1994 Korsmeier et al. ..... 123/527
5,993,743 A * 11/1999 Nordman et al. ..... 422/94
6,192,874 B1 * 2/2001 Dekoninck et al. ..... 123/697

* cited by examiner

*Primary Examiner*—Willis R. Wolfe
*Assistant Examiner*—Mahmoud Gimie
(74) *Attorney, Agent, or Firm*—Jennifer Stec

(57) ABSTRACT

A method and apparatus for controlling universal exhaust gas oxygen (UEGO) sensors comprises an application specific integrated circuit (ASIC) that includes a sensor control utilizing proportional-integral-derivative control loop, sensor drivers for generating pumping currents that reflect the changes of voltages representative of oxygen levels in the reference and test chambers of the UEGO sensor, a communication circuit for communicating with an engine control module, and output buffers for conditioning replications of the pumping current for delivery to an output circuit. In addition to the ASIC, a sensor interface conditions the sensor signals and an output circuit transforms the pumping circuit replications to compatible inputs for the engine control module. Preferably, all of the circuits are formed on a portion of a circuit board in the engine control module. A trim compensation circuit compensates for sensor deviation from an ideal performance standard. The output circuit clamps the voltage range to avoid undesirable inputs to the engine control module.

21 Claims, 5 Drawing Sheets

D3
5V
5V
D4
26
R18
R19
Vtr1
Vtr1
Vtr2
Vtr2
C1
C2
R31
VtrGND
R30
22
Vs1(+)
Vs1(+)
C5
VPWR
R5
R3
C27
R7
D5
R1
C23
C25
Vp1(+)
Vp1(+)
C6
VPWR
C21
D9
C28
R8
VCOM
VCOM
C26
C7
C22
C24
R2
R6
R4
C35
C36
Vs2(+)
Vs2(+)
C9
VPWR
D7
Vp2(+)
Vp2(+)
C8
OSM2
OSM1
24
R26
R25
HTR1
HTR1
HTR2
HTR2
Q1
Q2
G1
C10
C11
G2

UEGO CONTROL CIRCUIT BOARD PORTION WITH ASIC

TECHNICAL FIELD

The present invention relates to universal exhaust gas oxygen sensor control circuits providing a universal exhaust gas oxygen (UEGO) sensor interface and an output for an engine control module and employing an application specific integrated circuit (ASIC) with a plurality of control circuits.

BACKGROUND ART

Since fuel economy and improved power are desirable in the operation of internal combustion engines such as those used in automobiles, exhaust gas oxygen sensors have been used to indicate whether the air-fuel mixture is lean or rich for the current performance of the engine. While some sensors provide merely positive or no output in response to whether the mixture is rich or lean, universal exhaust gas oxygen (UEGO) sensors have been developed to provide multiple indications of the degree of adjustments needed to conform to a desired air-fuel ratio.

In general, a UEGO sensor includes a chamber with a controlled oxygen content separated by a permeable membrane from an adjacent chamber that receives exhaust gas oxygen. A reference voltage associated with the referenced oxygen content varies as the referenced oxygen content changes in response to the amount of oxygen contained in the adjacent chamber. A sensor control circuit for the UEGO sensor generates a pumping current and attempts to readjust the level of oxygen contained in the reference chamber to balance towards the optimum air fuel mixture. As a result, the pumping current reflects the richness or leanness of the air-fuel mixture being fed for combustion. The pumping currents may be monitored for adjustment of the air-fuel ratio in the engine control module. The sensor may be heated by a heater control circuit to maintain ambient conditions compatible with exhaust gas sensing.

The previously known UEGO sensors employ individual control circuits. A stand-alone unit such as an NTK Corporation T-6000 stand-alone UEGO controller controls a single sensor. A multiple sensor control system would require installation of multiple control circuits. As a result, a substantial amount of circuitry is required to be packaged near or on the engine with the engine controls. Moreover, the UEGO sensors operate in the harsh environment of exhaust gases, and thus subject locally located circuitry to heat, temperature variation, and vibration problems. In addition, in systems where multiple sensors are to be employed in order to properly adjust air fuel ratio for the engine, the exposure of multiple circuits and the difficulty of packaging the circuits in the automobile substantially reduce the reliability of such systems as previously employed.

DISCLOSURE OF INVENTION

The present invention overcomes the above-mentioned disadvantages by providing UEGO sensor control circuitry employed in large part on an application specific integrated circuit (ASIC) which, together with other associated circuitry, is particularly well adapted to communicate with or form a part of the engine control module. In general, the ASIC is constructed to perform sensor control functions including proportional-integral-derivative control processes for evaluating the air-fuel ratio and its relationship to the desired air-fuel ratio. In addition, sensing cell drivers, the heater control for the sensor, SPI communication control for compatible processing of information with the engine control module, a common power supply voltage generator (V com) and UEGO output buffers are formed wholly on the ASIC. Additional circuitry, such as a trim compensation circuit that compensates for sensor deviations from ideal manufacturing specifications, sensor interface circuitry that filters and conditions sensor signal outputs for input to the ASIC, and heater drive monitoring circuitry, all of which may be dependent upon the type of sensors employed, are preferably formed on a circuit board portion that is preferably a part of a circuit board in the engine control module. An output circuit that conditions the control circuit operation as input to the engine control module may also be populated on the circuit board portion.

In a preferred embodiment, a plurality of UEGO sensors are heated by heater circuitry and operated by controls in the ASIC. Sensors such as the NTK TL-7111-W1 include a trim resistor designating the type of variation exhibited by the sensor from ideal specifications that occurs during manufacturing. The compensation circuit forms a voltage-clamped, voltage divider providing a compensation signal to an analog to digital (A-D) converter at the engine control module. In the preferred embodiment, output circuitry that receives replicated sensor pumping current transforms the current into a differential voltage output that is then converted to a single-end or voltage output that is filtered for receipt at the engine control module. The output circuitry preferably includes voltage clamp for avoiding excessive input to the engine control module. Moreover, all of the above engine circuits may be provided on a portion of a circuit board that forms a part of a circuit board in the engine control module.

As a result, the present invention provides a UEGO sensor control circuit that has a substantially smaller package than previously known UEGO sensor control circuits. Moreover, the reliability of the circuits is substantially improved, and the circuit becomes more robust in the harsh environment of the engine compartment.

BRIEF DESCRIPTION OF DRAWINGS

The present invention will be more clearly understood by reference to the following detailed description of a preferred embodiment when read in conjunction with the accompanying drawing, in which like reference characters refer to like parts throughout the views and in which.

BEST MODE FOR CARRYING OUT THE INVENTION

Figure 1:
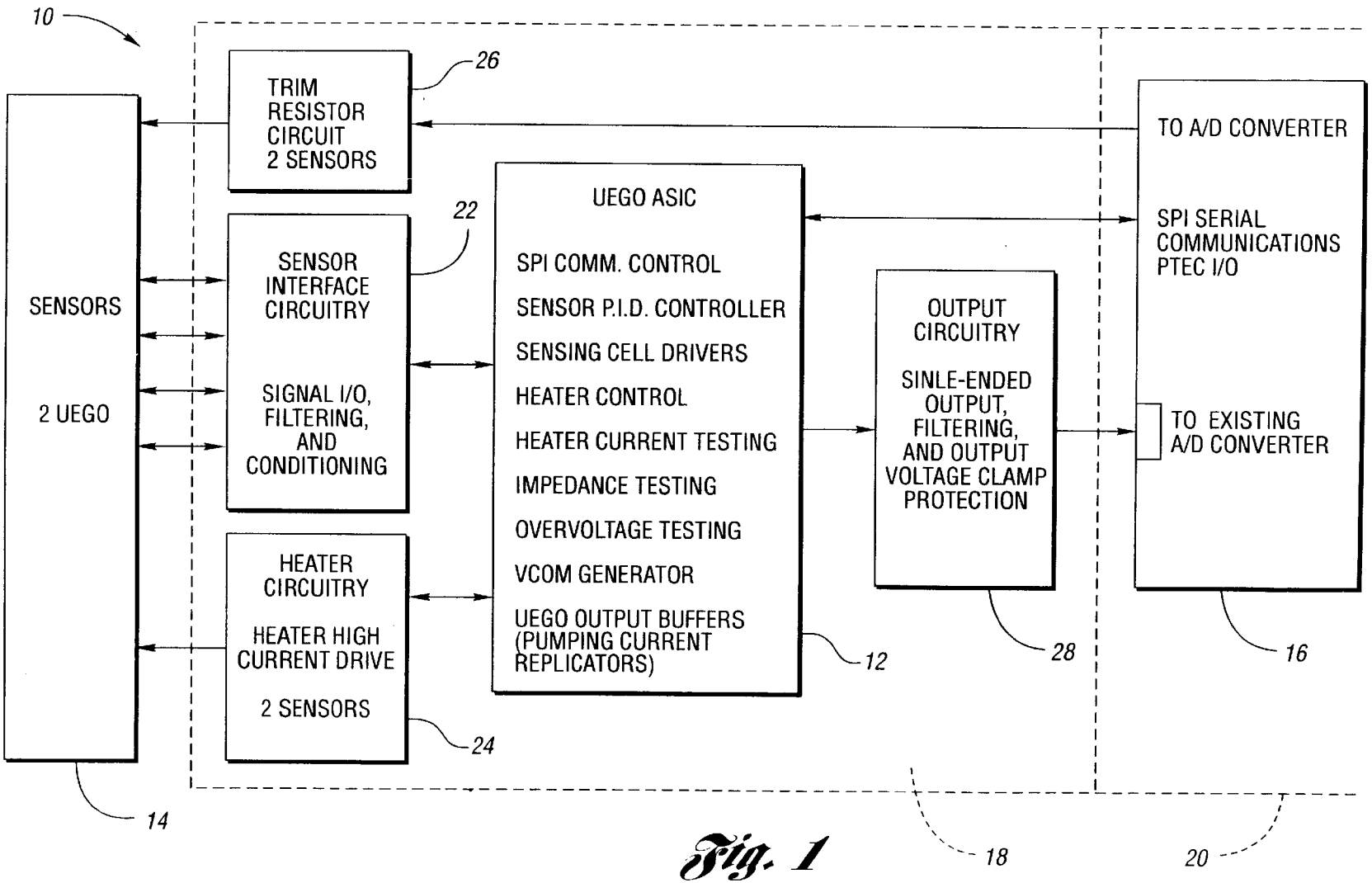
FIG. 1 is a block diagram of a UEGO control circuit system for an air-fuel ratio control system according to the present invention.

Referring first to FIG. 1, a universal exhaust gas oxygen (UEGO) control system 10 includes an application specific integrated circuit 12 that couples two UEGO sensors 14 and controls them for generating useful input signals to an engine control module 16. In the preferred embodiment, the circuitry measures the air-fuel ratio for the two separate channels, although it will be understood that at least one sensor of UEGO type or other styles of exhaust gas oxygen sensors may be used with the control system of the present invention. While at least one sensor, but preferably a plurality of sensors, for example, two NTK TL-7111-W1 sensors, detects the information required for the engine control module, each sensor is located proximate to an exhaust passageway so that a chamber of the sensor may be provided with the exhaust mixture to detect the amount of oxygen remaining after combustion.

The remainder of the circuits in the system are preferably housed on a circuit board portion 18. Preferably, the portion 18 is part of circuit board 20 housed in the engine control module 16. In addition to the ASIC 12, the circuit board portion 18 includes sensor interface circuit 22, heater circuit 24, a trim compensation circuit 26 and output circuit 28. Additional circuits may be employed as necessary, such as heated exhaust gas oxygen (HEGO) sensors, to provide additional control signals to the engine control module 16.

The UEGO ASIC includes communication control for communicating with a processor associated with the engine control module 16. In the preferred embodiment, serial peripheral interface (SPI) protocol communication is chosen for compatibility with existing components, although other communication systems could be used. In addition, a proportional-integral-derivative controller loop for detecting changes of voltage corresponding to oxygen level changes at the sensor chambers of sensors 14 is provided for each of the plurality of sensors employed with the system. Furthermore, the ASIC 12 includes sensing cell drivers for generating a pumping current that reflects the changes in oxygen displacement between the reference and test chambers at sensor 14. The UEGO output buffers, which replicate the pumping current, are provided as input to the output circuitry 28.

Preferably, the UEGO ASIC 12 of the preferred embodiment includes a heater control so that the sensor heater provides constant test conditions for the oxygen comparison that generates electrical changes at the sensor 14. In addition, the preferred embodiment includes a heater current testing circuit, an impedance testing circuit, and an overvoltage testing circuit, that assure proper operation of the sensors 14. The ASIC further includes a power supply voltage (V com) generator for generating a common voltage that applies to operation of all the sensing circuits within and outside of the ASIC 12.

Figure 2:
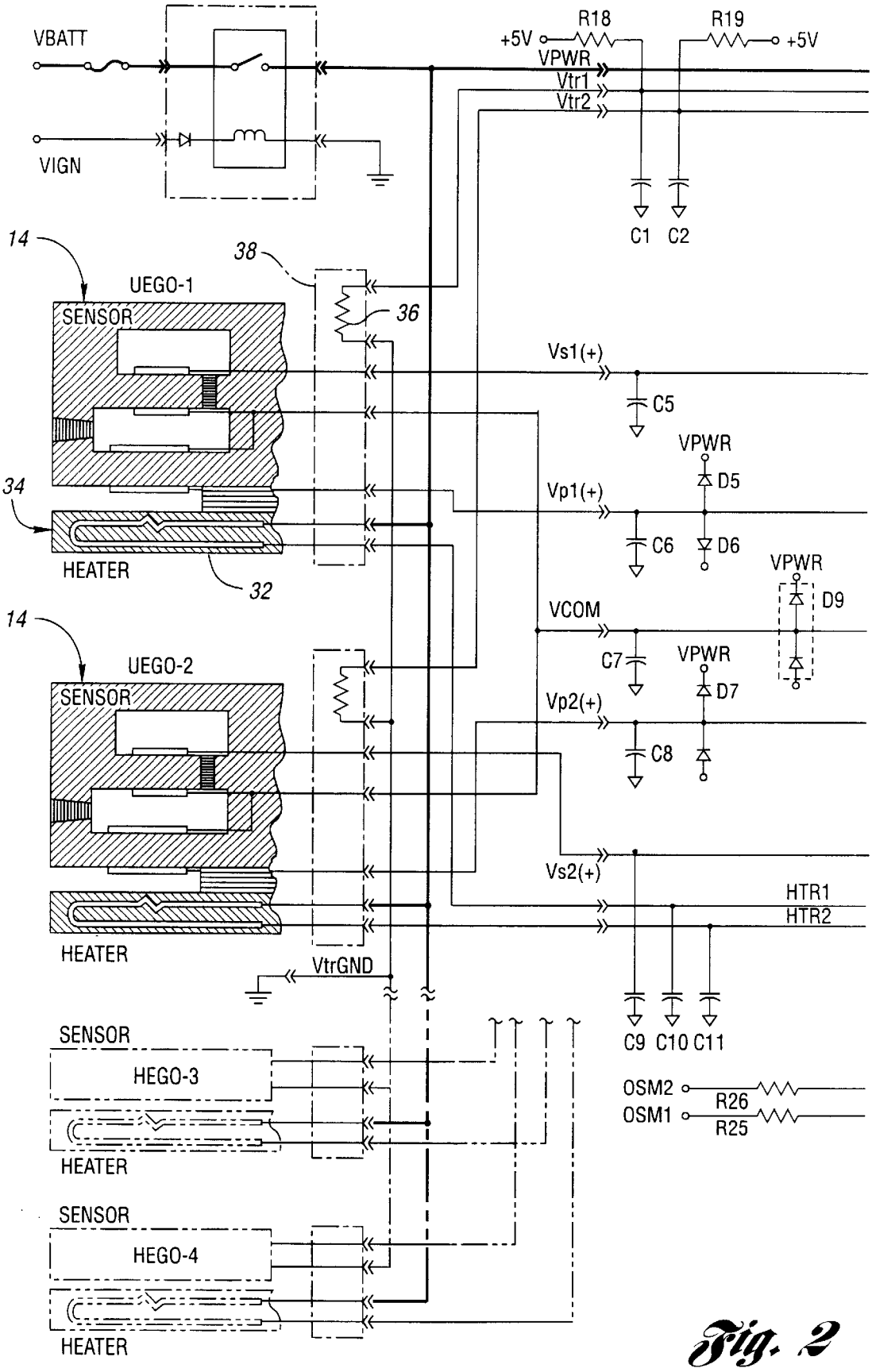
FIG. 2 is a schematic diagram of sensors and a portion of the system shown in FIG. 1.
Figure 3A:
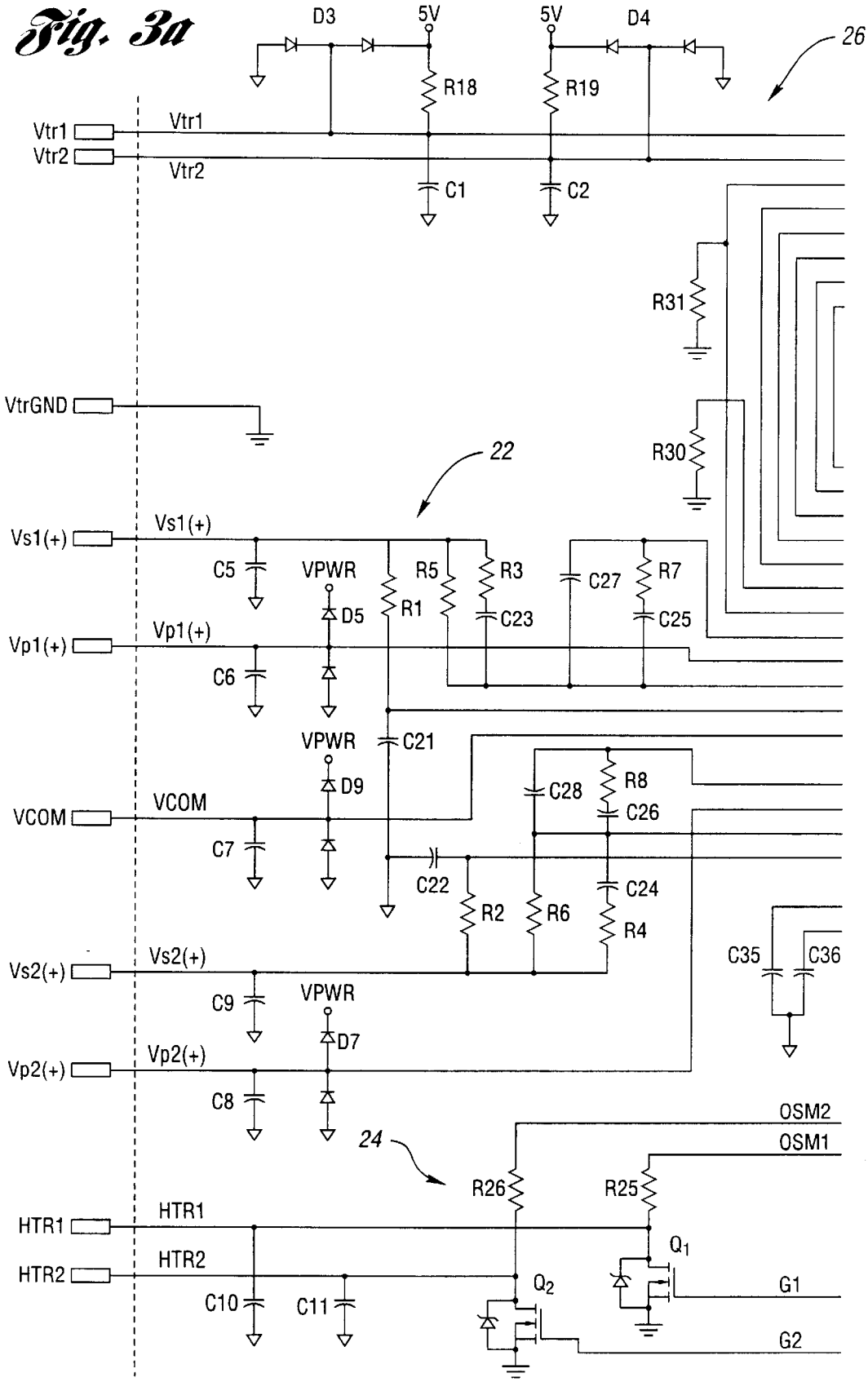
FIG. 3*a* is a schematic diagram of a circuit board portion including the input interface and the voltage trim circuit and heater circuit for a UEGO sensor according to the present invention.

A first connection between the ASIC 12 and the sensors 14 is a sensor interface circuit 22 that includes signal input/output, filtering and conditioning. In the preferred embodiment, such filtering and signal conditioning is shown in FIG. 3*a* in detail, although other clamps and dividing circuits may be employed without departing from the present invention. As shown in FIGS. 1 and 2, a heater element 32 mounted in a sensor housing 34 is coupled to the heater drive current circuitry 24. For production car implementation, an ignition relay circuit may be used, as is well known, to compatibly couple the sensor control circuitry with reverse battery protection.

As shown in FIGS. 2 and 3*a*, a calibration resistor 36 is mounted on a terminal 38 associated with the housing 34. The value of the resistor 36 is selected by the manufacturer depending upon the deviation of the sensor from an ideal sensor operation. The trim compensation circuit 26 forms a voltage divider with the calibrating resistor 36 so that proper compensation for each of the different signals delivered from each of the sensors 14 is properly compensated for in the electronic control module 16. The output of the divider is input to an analog to digital converter in the engine control module 16 processing. The trim compensation circuit 26 is preferably a clamp-protected, pull-up resistor for each UEGO sensor 14. The voltage divider produces a voltage representative of the resistor value within the sensor 14, thereby providing a signature that is used to compensate for any manufacturing inaccuracy of the sensor 14 itself.

Figure 3B:
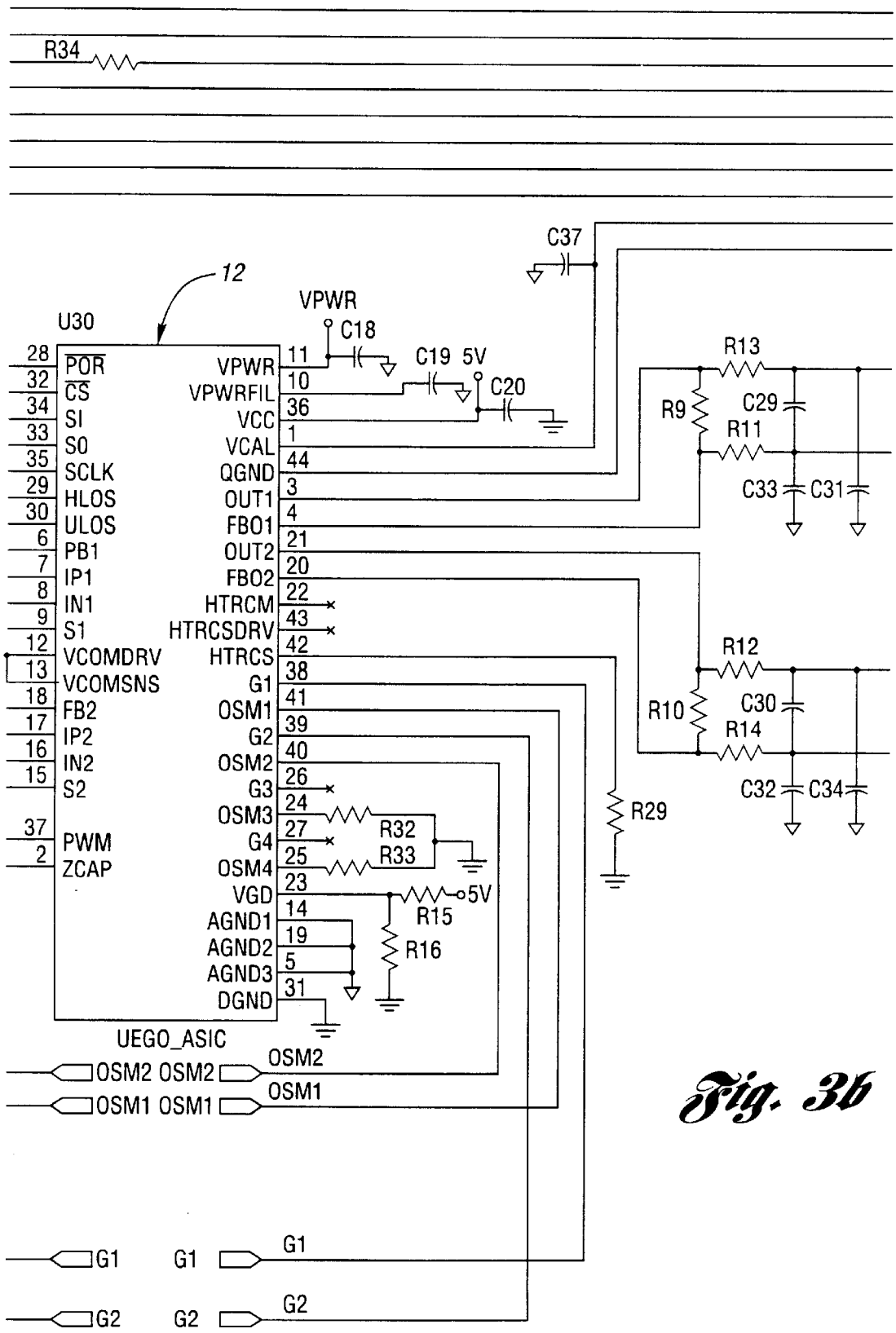
FIG. 3*b* is another portion of the circuit board shown in FIG. 3*a*, including the ASIC connections to the circuit board portion according to the present invention.

In addition, as best shown in FIG. 3, the heater circuit 24 consists of two low side, power FETs Q and $Q_2$ that switch heater current in pulse width modulation form under control of the ASIC 12. As a result, the heater circuitry in the sensor 14 matches temperature conditions of the exhaust gases to reduce discrepancies in the readings output from the sensors 14. The heater current monitor feature of the ASIC 12 may be eliminated in applications, such as Racing applications, where performance conditions other monitoring priorities.

Figure 3C:
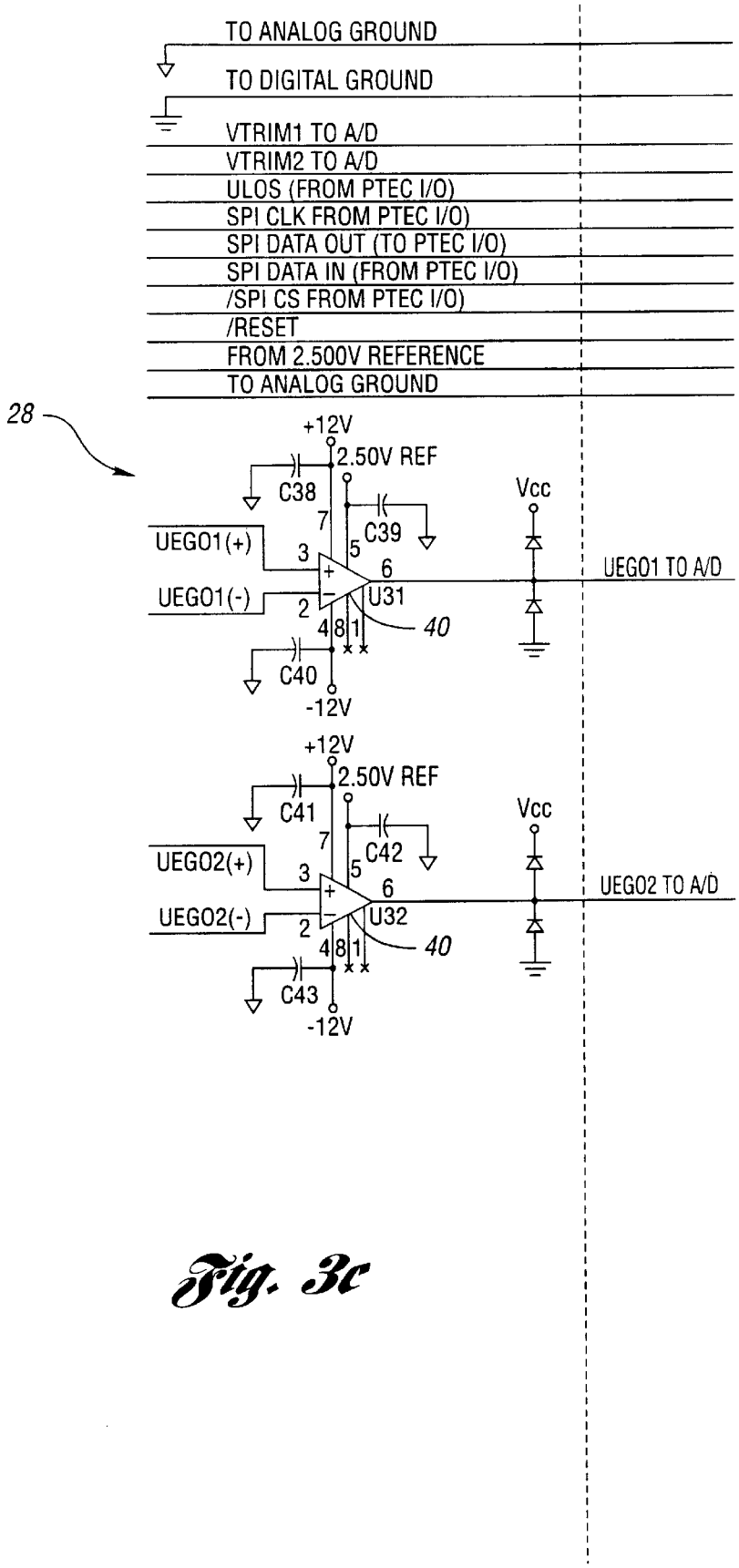
FIG. 3*c* is a schematic diagram of a circuit board portion showing the output circuit of a preferred embodiment according to the present invention.

As best shown in FIG. 3*c*, the output circuit 28 uses the replicated pumping currents from the ASIC 12 to create a differential DC voltage for each sensor. The differential voltage is then filtered and converted into a single-ended 0–5 volt range voltage using a difference amplifier 40. The voltage is clamped by the clamping diodes so that voltage output does not exceed 5.35 volts when fed into the engine control module 16 to convey the air-fuel ratio information. The output range of 0–5 volts is centered about a 2.5 volt reference point that can be adjusted if desired, for example, if more resolution is desired in a given voltage range. The clamped voltage is then connected directly to an analog to digital converter in the engine control module 16, as shown in FIG. 1.

Having thus described the preferred embodiment of the present invention, many modifications will become apparent to those skilled in the art to which it pertains without departing from the scope and spirit of the present invention as defined in the appended claims.

What is claimed is:

1. A UEGO sensor control circuit package for a UEGO sensor comprises:

a sensor interface for at least one sensor;

an ASIC coupled to the sensor interface and internally comprising a proportional-integral-derivative (P-I-D) control for at least one sensor, a SPI communications control for communicating with an engine control module, a heater control, a power supply voltage generator, sensing cell drivers delivering a pumping current in response to said P-I-D control, and output buffers for replicating said pumping current from each sensor; and an output receiving said replications of said pumping current and converting it to an input for said engine control module, said output including a clamp for limiting maximum voltage applied to said engine control module.

2. The invention as defined in claim 1 and further comprising a trim compensation circuit for each sensor for compensating output relative to a recognized variance from a sensor characteristic.

3. The invention as defined in claim 2 wherein the UEGO sensor further includes a selected calibration resistor, and wherein said trim compensation circuit forms a voltage divider with said calibration resistor.

4. The invention as defined in claim 1 and further comprising a heater test circuit for monitoring heating current.

5. The invention as described in claim 1 and further comprising a heater test circuit for testing faults in the heater.

6. The invention as defined in claim 1 and further comprising an impedance tester for monitoring the impedance of the sensor.

7. The invention as defined in claim 1 and further comprising an over-voltage tester for monitoring voltage applied to the sensor.

8. The invention as defined in claim 1 and further comprising a voltage trim circuit for monitoring compliance of said at least one sensor with a desired specification.

9. The invention as defined in claim 8 wherein said sensor includes a calibrating resistor and said voltage trim circuit forms a voltage divider with said resistor.

10. The invention as defined in claim 1 comprising a heater circuit including field effect transistors.

11. The invention as defined in claim 1 wherein said output includes a differential amplifier for reducing noise at said input.

12. A UEGO sensor control circuit package for operating an engine control module in response to sensor outputs, the control circuit package comprising:

a sensor interface for two UEGO sensors;

an ASIC internally comprising a proportional-integral-derivative control for said two sensors, an SPI communications control for communicating with said engine control module, a heater control, a power supply voltage generator, and output buffers for replicating a pumping current for each UEGO sensor;

an output receiving said replications of said pumping current and converting it to an input for said engine control module; and wherein said interface, said ASIC and said output are mounted on a portion of a circuit board contained in said engine control module.

13. The invention as defined in claim 12 wherein said control circuit and said circuit board portion include a voltage trim circuit for monitoring compliance of each said sensor with a desired specification.

14. The invention as defined in claim 12 wherein said control circuit and said circuit board portion includes a heater driver for said sensors.

15. The invention as defined in claim 12 wherein said control circuit and said circuit board portion includes a clamping circuit for limiting the voltage of said input for said engine control module.

16. A method for installing a universal exhaust gas oxygen sensor control circuit in a motor vehicle with an engine having exhaust gases in contact with at least one universal exhaust gas oxygen sensor comprising:

packing a plurality of circuits in a special application integrated circuit including a proportional-integral-derivative control, a communications control for communicating with an engine control module processor, and output buffers for replicating a pumping current at each sensor;

interfacing said specific application integrated circuit with each said sensor through a signal conditioning circuit; and coupling said buffers to a converting circuit for generating a fixed range output voltage through a clamping circuit for limiting maximum voltage input to said engine control module.

17. The invention as defined in claim 16 further comprising performing said packing, interfacing and coupling steps on a single circuit board.

18. The invention as defined in claim 16 further comprising trimming each sensor for output compensation depending on a deviation from a performance standard.

19. The invention as defined in claim 18 further comprising performing said packing, interfacing, coupling and trimming steps on a single circuit board.

20. The invention as defined in claim 16 further comprising driving a heater in each said sensor.

21. The invention as defined in claim 20 further comprising performing said packing, interfacing, coupling and driving steps on a single circuit board.

* * * * *